United States Patent [19]

Rosen

[11] Patent Number: 4,523,415

[45] Date of Patent: Jun. 18, 1985

[54] ONE-PIECE BUILDING PANEL FOR WALLS AND LIKE STRUCTURES

[76] Inventor: Milton Rosen, 800 NE. 155 St., North Miami Beach, Fla. 33162

[21] Appl. No.: 573,850

[22] Filed: Jan. 25, 1984

[51] Int. Cl.[3] ..... E04C 2/52

[52] U.S. Cl. ..... 52/220; 52/221; 52/606

[58] Field of Search ..... 52/220, 221, 606, 607, 52/503, 806, 785, 808, 821, 823, 824, 601, 505

[56] References Cited

U.S. PATENT DOCUMENTS

| | | | |
|---|---|---|---|
| 2,114,387 | 4/1938 | Killion | 52/601 X |
| 2,238,355 | 4/1941 | Whitenack | 52/601 |
| 2,336,506 | 12/1943 | Saunders | 52/785 X |
| 3,220,151 | 11/1965 | Goldman | 52/606 X |
| 3,503,165 | 3/1970 | Hardt | 52/607 X |
| 3,609,926 | 10/1971 | Muse | 52/503 X |
| 3,959,423 | 5/1976 | Boyd | 52/220 X |
| 4,010,581 | 3/1977 | Keturi et al. | 52/220 |
| 4,110,949 | 9/1978 | Cambiuzzi et al. | 52/606 X |
| 4,164,831 | 8/1979 | Messick et al. | 52/601 X |
| 4,232,183 | 11/1980 | Person | 52/221 X |
| 4,370,372 | 1/1983 | Higgins et al. | 52/785 X |

FOREIGN PATENT DOCUMENTS

| | | | |
|---|---|---|---|
| 131501 | 2/1949 | Australia | 52/221 |
| 2274749 | 1/1976 | France | 52/220 |
| 2378147 | 9/1978 | France | 52/220 |
| 312925 | 4/1956 | Switzerland | 52/606 |

*Primary Examiner*—J. Karl Bell

*Attorney, Agent, or Firm*—John Cyril Malloy

[57] ABSTRACT

A building panel preferably formed of cast, one-piece construction and made of a substantially lightweight cementitious material such as gypsum wherein a front and a rear external face are disposed on opposite sides and integrally connected to an apertured interior portion defined by a plurality of adjacently positioned apertures of predetermined configuration such as a hexagon or the like. A peripheral border surrounds the exterior of the panel and includes a specifically configured recess extending along a portion of the length thereof such that correspondingly positioned peripheral borders of adjacently positioned and interconnected panels form channels through which utility lines may be extended. Connector elements are specifically placed to interengage adjacently positioned panels for interconnection to one another.

14 Claims, 12 Drawing Figures

ONE-PIECE BUILDING PANEL FOR WALLS AND LIKE STRUCTURES

BACKGROUND OF THE INVENTION

1. Field of the Invention

The present invention is directed towards a building panel formed of one-piece construction of lightweight material such as by casting wherein the panels include a front and a rear face and an interior portion sandwiched therebetween and including a predetermined array of adjacently positioned apertures each having a predetermined configuration. The panels are specifically structured for interconnection to one another to independently or collectively form interior or exterior wall structures in buildings.

2. Description of the Prior Art

Numerous structural designs, materials and facilities are utilized in modern day building construction for the purpose of building both interior and exterior walls. Such include substantially conventional building block or brick structures as well as what may be considered preformed panels. In using the latter described construction, such panels are generally preformed of permanent building material such as concrete, etc. and interconnected to one another by a variety of methods.

In the design and structure of preformed panels, normally different materials and design features are incorporated when considering building of an exterior as versus an interior wall structure. Generally, exterior walls are built of heavier, more durable material such as cementitious material and/or reinforced concrete or concrete block and are much heavier in that they are frequently intended to be load-bearing. Interior wall structures are normally considered much lighter in both material utilized and structural design incorporated and oftentimes are not suitable for the construction or incorporation as exterior walls in either commercial or residential buildings.

Accordingly, there is a need for a building panel preferably of one-piece construction formed of cementitious or like substantially lightweight material as by casting wherein the panel is sufficiently designed to incorporate structural features capable of bearing applicable loads thereon.

SUMMARY OF THE INVENTION

The present invention relates to building panels of the type formed of one-piece construction as by casting, preferably from a lightweight, at least partially cementitious material such as gypsum, plaster of Paris, etc. Further the panel is specifically designed and structured to be used in the construction of either interior or exterior walls which may at least in part be load bearing.

More specifically, the subject building panel comprises a front face and a rear face each preferably including a planar outer surface wherein each of these faces are disposed in substantially spaced apart relation to one another but integrally connected by means of an interior portion. The interior portion comprises a planar array of apertured construction substantially defined by a plurality of directly adjacent apertures of common configuration each of which are separated by contiguously disposed spacer wall. Depending upon the particular application for which the panel is intended, the apertures may vary in configuration, but normally all apertures in a given panel have a common configuration. More specifically, the hexagonal configuration has been found to be structurally sound especially when utilized in the subject panel structure for load bearing panel or walls. While somewhat more complex, in that the hexagon has a multi-sided periphery, a collection or array of such apertured construction has been found to indure stress or exhibit load bearing properties somewhat more efficiently than other configurations. However, when the panel is not intended to be incorporated as a load bearing wall, other somewhat less complex configurations such as circles, rectangles, etc. may be incorporated. Regardless of the configuration of the apertured construction, the latter is disposed in substantially sandwiched but integrally connected relation to each of the front and rear faces.

The panel further includes a border means in the form of spaced apart, substantially parallel vertical peripheral portions and also spaced apart, substantially parallel horizontal peripheral portions; all of the peripheral portions collectively defining a periphery having a substantially rectangular configuration.

Further, both the vertical peripheral portions include a first recess extending along at least a portion of the length thereof wherein each of the first recesses includes an insert preferably having a concave cross sectional configuration. Similarly, a second recess is formed along at least a portion of the length of the horizontal peripheral portion wherein the cross sectional configuration of the second recesses may be substantially the same as that of the first recesses.

Adjacently positioned panels may be disposed in side-by-side and interconnected relation to one another such that correspondingly positioned first recesses of adjacently positioned panels are disposable in substantially mating aligned relation to one another to form vertically oriented channel means extending along the length of the recesses wherein each channel means has a substantially closed cross sectional configuration which is sufficiently dimensioned to house or maintain utility lines (plumbing or electrical conduit) along the length thereof. The versatility of such a structure is obvious in that the various utility lines required in modern-day residential and commercial building construction can be disposed throughout either interior or exterior walls which incorporates building panels of the present invention.

Further structural features of the present invention include conduit means including at least one and preferably two elongated, hollow conduit elements extending between oppositely disposed and parallel vertical peripheral portions of a given panel. Each of the conduit elements are spaced a predetermined distance from one of the upper or lower horizontal peripheral portion. When adjacently positioned, side-by-side panels are disposed in connected relation to one another, such correspondingly positioned conduit elements are disposed in substantially linearly aligned relation to one another. A single conduit passage is thereby formed from a plurality of aligned conduit elements each formed in adjacently positioned and connected building panels; wherein the building panels themselves, when adjacently positioned and interconnected, collectively form a given wall structure.

Connector means in the form of a connector element is structured and configured to fit in substantially telescopic relation to bell-shaped opposite ends of each conduit element so as to maintain interconnection between the adjacently positioned panels and properly align such panels such that the respective conduit elements thereof are themselves maintained in coaxial alignment with one another. Further, the connector elements are hollow along the length thereof and in a preferred embodiment have an inner diameter substantially equal to the inner diameter of the conduit elements which they serve to interconnect.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the nature of the present invention, reference is made to the following detailed description taken in connection with the accompanying drawings, in which.

Like reference characters refer to like parts throughout the several views of the drawings.

DETAILED DESCRIPTION OF THE PREFERRED EMBODIMENT

Figure 1:
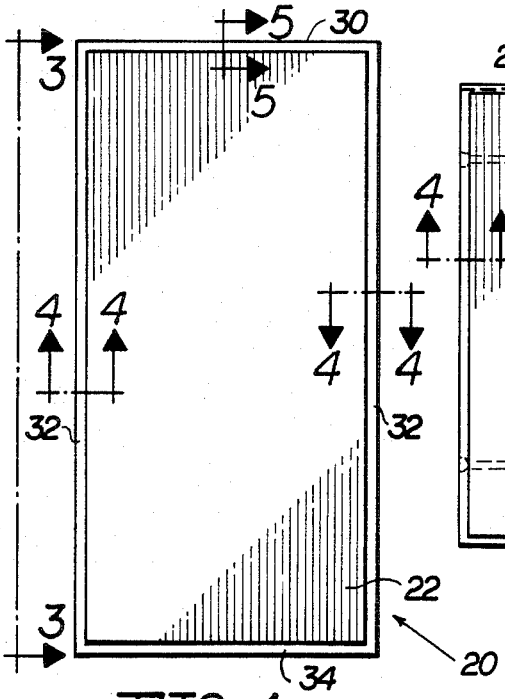
FIG. 1 is a front plan view of the building panel of the present invention.

As shown in FIG. 1, the present invention is directed towards a building panel generally indicated as 20 comprising a front face 22 an a rear face 23 each having a substantially planar exposed surface and integrally secured and interconnected to one another by an interior portion generally indicated as 68 defined by an apertured construction comprising a plurality of adjacently positioned apertures 72 collectively disposed to extend in transverse relation to the longitudinal axis of the panels thereby defining a substantially planar array. Each of the aprtures 72 are separated from one another by a contiguous spacer wall 70 also integrally secured in interconnecting relation between the front and rear faces 22 and 23 respectively. It is therefore seen that the spacer walls 70 as well as apertures 72 extend in transverse relation to front and rear faces 22 and 23 respectively. When the panels are arranged in an upright orientation such as when properly placed as walls or the like, the plurality of apertures 72 as well as the surrounding spacer walls 70 extend or are oriented in a substantially horizontal position.

Figure 6:
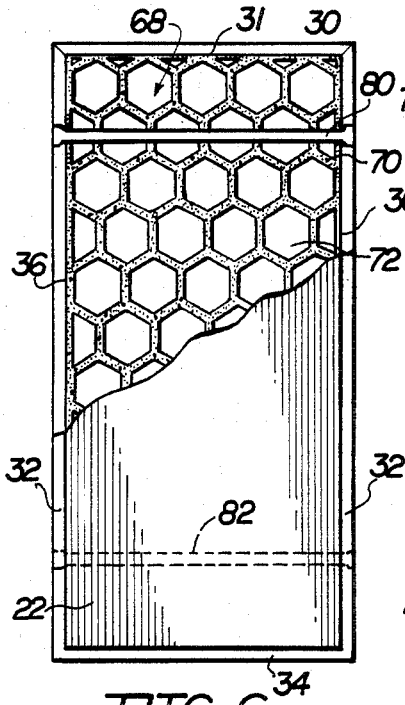
FIG. 6 is a front plan view in partial cutaway of one embodiment of the building panel structure of the present invention.
Figure 7:
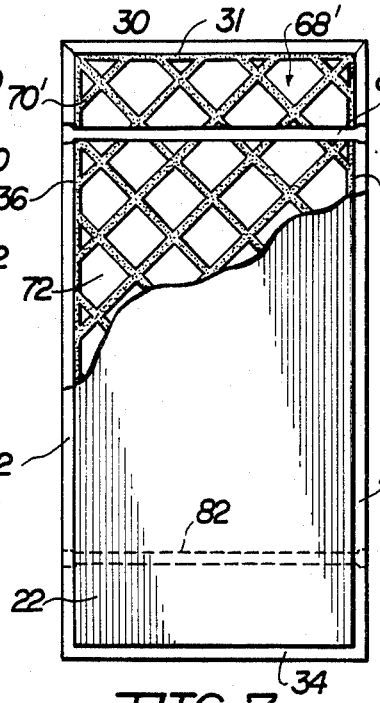
FIG. 7 is a front plan view in partial cutaway of another embodiment of the building panel of the present invention.
Figure 8:
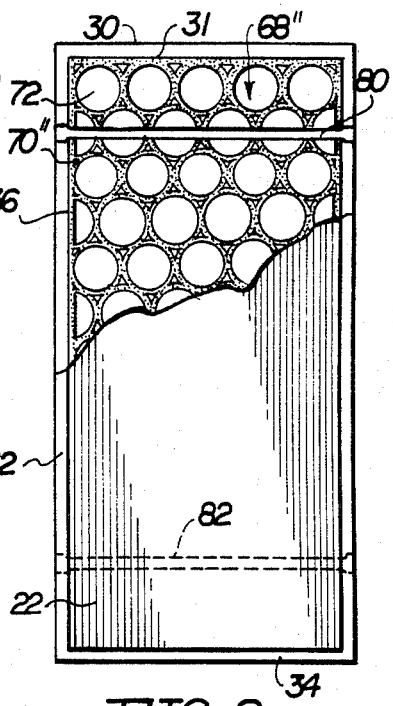
FIG. 8 is a front plan view of yet another embodiment of the building panel of the present invention.

With specific references to FIGS. 6, 7 and 8, the specific configuration of each of the apertures 72 may vary depending upon the particular application for which the building panel 20 is intended. When such panel is intended to be incorporated as part of a load bearing wall structure, it has been found that a hexagonal configuration (FIG. 6) is best suited for load bearing performance or capabilities. However, rectangular or circular shaped apertures 72' and 72'' respectively are also utilized, as well as other configurations, again depending upon the particular application for which a given building panel is intended. Similarly, the spacer wall 70' and 70'' is similarly configured in that such spacer walls are contiguous to each of a plurality of adjacently positioned apertures in a given building panel construction.

Figure 4:
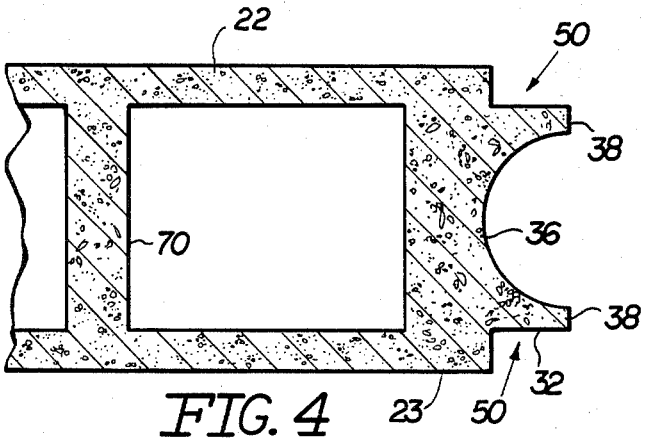
FIG. 4 is a sectional view taken along line 4—4 of FIG. 1.
Figure 5:
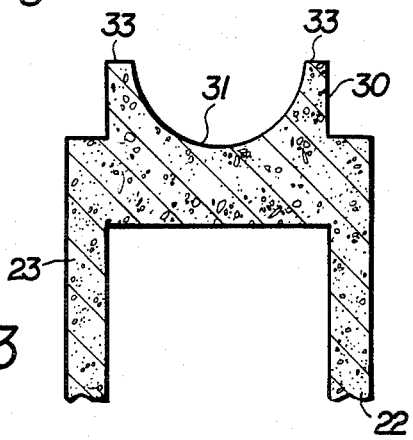
FIG. 5 is a sectional view taken along line 5—5 of FIG. 1.
Figure 5A:
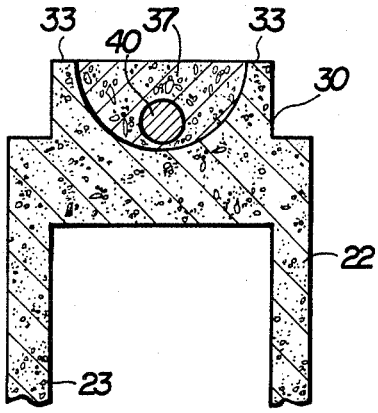
FIG. 5A is another embodiment of the present invention taken along line 5A—5A of FIG. 2 of the present invention.

Other structural features of the present invention include the provision of a border means disposed to define the outer, surrounding periphery of each panel. The border means may include vertical peripheral portions 32 integrally secured to the remaining panel structure and horizontal peripheral portion 30 also integrally secured as set forth above. Both the vertical and horizontal peripheral portions 32 and 30 extend the length of the periphery of the building panel along which they extend. A first recess 36 extends along at least a portion, and preferably the entire length of each of the vertical peripheral portions. Similarly, a second recess 31 extends along at least a portion, and preferably the entire length of the horizontal peripheral portions 30 wherein each of the respective recesses have an inset configuration (preferably a concave) with exposed spaced apart edges 38 (FIG. 4) and 33 (FIG. 5) respecively. Therefore, with regard to FIG. 9, adjacently positioned panels 20 and 20' may be interconnected to one another in such a manner that edges 38 and 38' are disposed in abutting relation to one another such that first recesses 36 and 36' of respective panels 20 and 20' form an elongated channel means which extends along the vertical peripheral edge of the adjacently positioned panels 20 and 20'. Therefore, the cross-sectional configuration of the formed channel means is effectively closed and further structured and dimensioned to house or maintain utility lines (not shown) therein for proper placement in commercial or residential building being constructed or modified. It should be noted that the term "vertical" and "horizontal" are used herein with reference to an upright or upstanding orientation of the panels as disclosed in FIGS. 1, 2, 6, 7 and 8.

Figure 9:
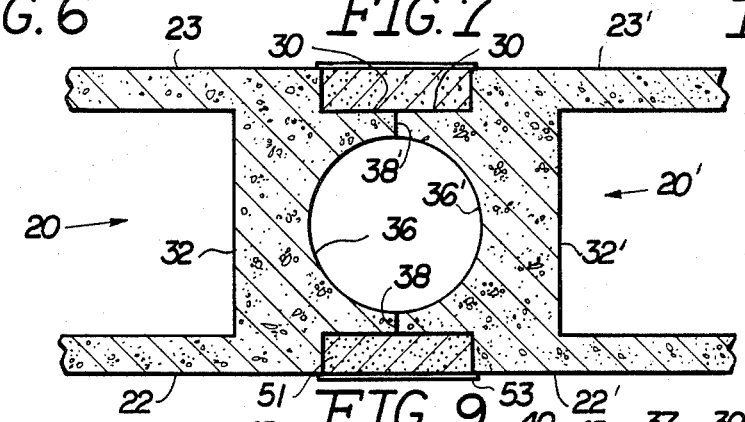
FIG. 9 is a sectional view taken along line 9—9 of FIG. 2.
Figure 11:
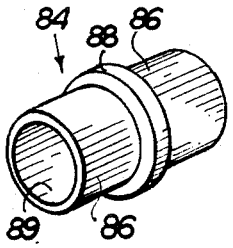
FIG. 11 is a detailed isometric view of a connector element structure to interconnect and maintain alignment between adjacently positioned building panels of the present invention.

Further with regard to FIG. 9, it may be desirable to provide a sheet of fibrous or other applicable material disposed in embedded relation beneath the outer faces as at 22' and 23' of a panel preferably at a depth of about 1/16th inch. This sheet provides reinforcing and adds strength to the overall structure so that if the panel is oriented or carried with the faces 22' and 23' aligned horizontally instead of vertically, the panel does not bend or break easily. This sheet may have a net or screen-like structure such as chicken wire or screening or may be formed of other material such as burlap or the like.

Figure 10:
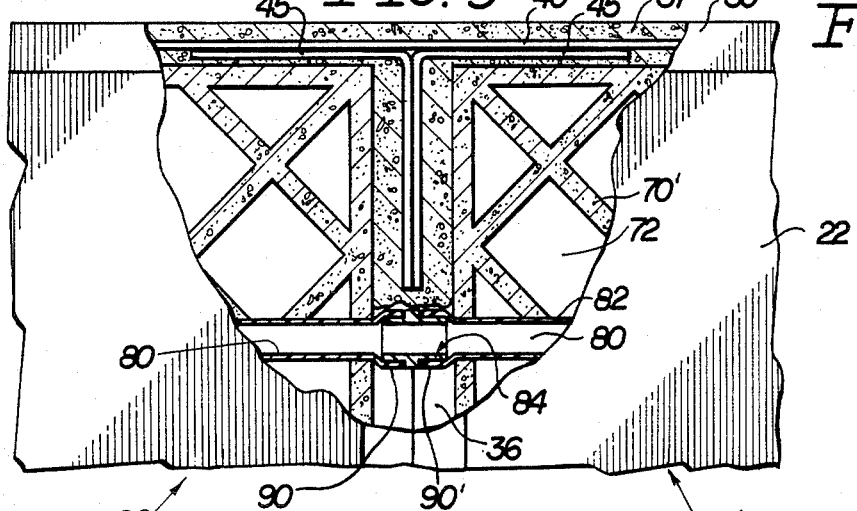
FIG. 10 is a sectional view in partial cutaway along line 10—10 of FIG. 2.

As shown in FIG. 10, the second recesses along with possibly an upper portion of the first recess may include the provision and/or formation of tie beams 37 therein. In such an embodiment a concrete or like cementitious material may be poured in the second recesses 31 and in the upper portion of the first recesses matingly positioned to form the aforementioned conduit means. Reinforcing bar, commonly known as rebar 40 and/or 45 may be disposed within the concrete or cementitious material 37 in the conventional surrounded fashion so as to form tie beams along the upper horizontal peripheral portions of adjacently positioned and interconnected building panels, 20, 20' and 20'' (see FIG. 2). It should be emphasized that while such a tie beam construction is possible, it is not a requirement or a necessity in forming wall structures in general or in interconnecting a plurality of side-by-side building panels.

Also referring to FIG. 10, the top tie beam can be connected or secured to a supporting floor structure by means of a vertical tie column 47 which may also have additional reinforcing bars 45'.

Other structural features of the present invention include the provision of conduit means 80 and 82 disposed in interconnected and communicating relation between opposite vertical peripheral portions of each panel. Further, each of the conduit means 80 and 82 are formed a predetermined distance from upper and lower horizontal peripheral portions 30 and 34 respectively (FIGS. 6 through 8). Such conduit means may be formed of galvanized metal, PVC or like material and include a hollow interior portion extending along the length thereof. Further, the spacing of the conduit means 80 and 82 relative to the spaced apart parallel peripheral portions is substantially constant or uniform in each building panel such that the various conduit means may be disposed in a linearly aligned, substantially coaxial relation to one another (see FIG. 2). Further, in order to insure proper alignment and/or interconnection between adjacently positioned panels 20 and 20' (FIG. 10), a connector element generally indicated as 84 is provided in telescoping relation on the interior of bell-shaped ends 90 and 90' of conduit means 80 and 80' which are disposed in aligned, mating relation to one another. An annular flange or ridge 88 may be disposed in surrounding relation to the outer surface 86 and disposed in flush engagement with the distal annular edges of each bell-shaped opposite end 90 and 90' so as to form a flush engagement. Alternately, the annular flange 88 may be deleted entirely and the outer surface 86 has a substantially smooth continous cylindrical configuration. In addition, the interior as at 89 of each connector element 84 is hollow and has an interior diameter substantially equal to the interior diameter of each of the connected conduit means 80 and 80'. Therefore, utility lines may be maintained and extend along the length of the interconnected conduit means 80 and 80' and also pass through the connector element 84 for purposes of adding versatility in placement of such utility lines in the construction and/or renovation of commercial and residential buildings.

Figure 2:
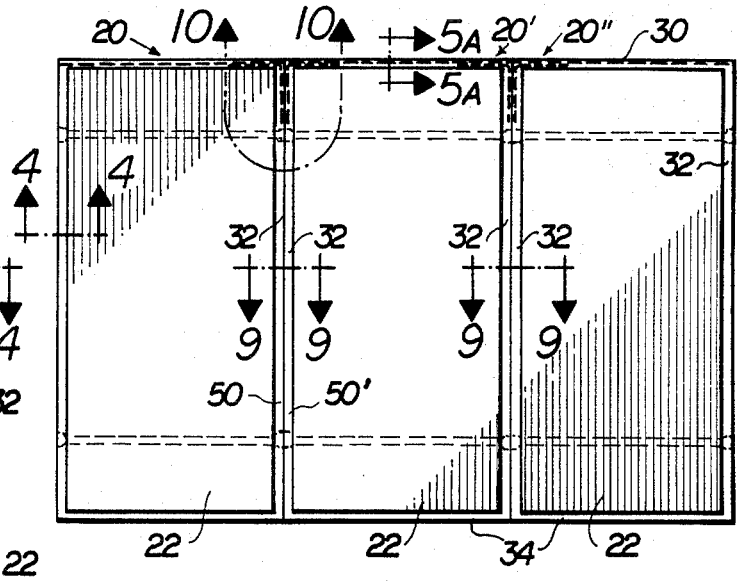
FIG. 2 is a front plan view of adjacently positioned and interconnected building panel which may collectively define a wall structure.
Figure 3:
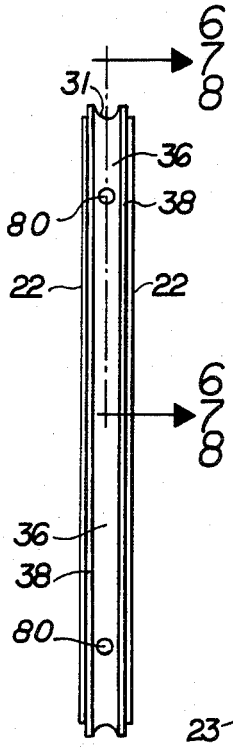
FIG. 3 is an end view taken along line 3—3 of FIG. 1.

Other structural features of the present invention include recesses formed between the various front and rear faces 22 and 23 and the vertical peripheral portions 32. Such elongated recesses generally indicated as 50 are also brought into mating engagement with adjacently positioned of such recesses 50' when adjacently positioned panels are brought into mating engagement with one another (FIG. 2). However, such recesses may be filled with mortar and/or joint, masking tape to provide a smooth essentially nondetectable surface joint between the panels when the exposed surfaces thereof are properly faced with sealing tape in the conventional manner. Another embodiment with regard to sealing tape 53 comprises the tape 53 being effectively embedded within the plaster of paris or mortar in order to eliminate any detection of seam structure.

What is claimed is:

1. A building panel of the type primarily designed for use as both interior and exterior walls, said building panel comprising:

(a) a substantially one-piece construction formed of lightweight, cementitious material and including a front face and a rear face each having outer surfaces disposed to define opposite exposed surfaces of said panel, (b) an interior portion disposed in sandwiched relation between said front face and said rear face and comprising a planar array of apertured construction defined in part by a plurality of apertures oriented in substantially transverse relation to said front and rear faces an extending therebetween, (c) said apertured construction further including spacer walls contiguously disposed to each of said plurality of apertures and defining the peripheral boundaries thereof, said spacer walls connected to one another and extending transversely to and in interconnecting relation between said front and rear faces, (d) border means disposed and structured for substantially defining a periphery of said panel and comprising vertically oriented peripheral portions disposed in spaced apart and parallel relation to one another, each vertical peripheral portion including a first recess extending along the length thereof, (e) said first recess positionable into substantially aligned, mating engagement with a correspondingly positioned first recess of a next adjacent positioned and connected building panel, (f) channel means for maintaining utility lines therein and having a substantially closed cross-sectional configuration and defined by mating engagement of said first recesses of said adjacently positioned building panels, and (g) conduit means mounted on said building panel for housing utility faciities therein and disposed in at least partially spaced relation to said channel means.

2. A building panel as in claim 1 wherein said conduit means is formed on the interior of said building panel and has an elongated, linear configuration being hollow along its length and extending between opposite vertical peripheral portions, opposite ends of said conduit means being structured and configured for mounting engagement with a connector element, said connector element secured to correspondingly positioned ends of aligned conduit means of adjacently positioned and interconnected building panels.

3. A building panel as in claim 2 wherein each of said connector elements includes a substantially elongated configuration and a hollow interior portion along the length thereof and disposed in communicating relation with said hollow interior of interconnected aligned conduit means.

4. A building panel as in claim 3 wherein each opposite end of said conduit means is defined by a substantially bell-shaped configuration dimensioned to telescopically receive one end of said connector element therein.

5. A building panel as in claim 2 wherein said conduit means comprises said hollow interior being dimensioned to include utility lines extending therethrough along the length thereof and disposed in substantially horizontal orientation extending between and in communication with opposite, vertical, peripheral edges of said building panel.

6. A building panel as in claim 2 wherein said conduit means comprises two conduit elements each including a hollow interior portion extending along the length thereof and each spaced from oposite ends of said panel and disposed to extend between and in communication with opposite vertical peripheral portions of said panel.

7. A building panel as in claim 6 wherein each opposite end of said conduit element is defined by a substantially bell-shaped configuration being dimensioned to telescopically receive one end of said connector element therein.

8. A building panel as in claim 1 wherein at least a majority of said apertures comprise a common cross-sectional configuration of substantially equal dimension and each disposed in substantially parallel, coplanar relation to one another and being substantially equally spaced from the next adjacent apertures.

9. A building panel as in claim 8 wherein the majority of said apertures are disposed in surrounded relation by a plurality of next adjacent apertures to define said planar array.

10. A building panel as in claim 9 wherein said spacer walls are integrally connected to define a one-piece construction of substantially constant thickness.

11. A building panel as in claim 1 wherein said border means further includes horizontal peripheral portions extending along spaced apart, substantially parallel upper and lower borders of said building panel, each horizontal peripheral portion including a second recess formed therein and including a common dimension extending along the length thereof, said second recess positionable into substantially aligned, mating engagement with a correspondingly positioned recess of a next adjacently positioned and connected building panel.

12. A building panel as in claim 11 further comprising tie-beam means formed in at least one of said first and said second recesses and defined by at least one steel rod element extending along the length thereof and including concrete material formed at least in part in said recesses in surrounding relation to said one steel rod.

13. A building panel as in claim 1 wherein the configuration of each aperture includes a substantially hexagonal shape.

14. A building panel as in claim 1 wherein insulation material is disposed on the interior of said interior portion at least partially within said plurality of apertures.

* * * * *